US006663074B2

(12) United States Patent
Prior

(10) Patent No.: US 6,663,074 B2
(45) Date of Patent: Dec. 16, 2003

(54) PORTABLE ARTIST'S HORSE

(76) Inventor: Frederick Prior, 28212 Turtle Rock Rd., Valley Center, CA (US) 92082

( * ) Notice: Subject to any disclaimer, the term of this patent is extended or adjusted under 35 U.S.C. 154(b) by 0 days.

(21) Appl. No.: 10/086,837

(22) Filed: Feb. 28, 2002

(65) Prior Publication Data

US 2003/0160145 A1 Aug. 28, 2003

(51) Int. Cl.[7] ..... A47B 97/08; A47B 3/087

(52) U.S. Cl. ..... 248/461; 248/439; 312/244; 312/249.8; 108/167

(58) Field of Search ..... 248/447, 448, 248/454, 455, 456, 460, 461, 462, 463, 464, 465, 469, 439, 440; 312/244, 249.8, 240, 241, 258; 108/166, 167, 168, 169, 170, 171, 172, 173, 174, 175, 25, 14

(56) References Cited

U.S. PATENT DOCUMENTS

| | | | | | |
|---|---|---|---|---|---|
| 3,079,167 | A | * | 2/1963 | Russell | 280/641 |
| 3,476,456 | A | * | 11/1969 | Canavan | 312/231 |
| 3,907,360 | A | | 9/1975 | Czarnowski | 297/156 |
| 4,034,518 | A | * | 7/1977 | Trecker | 5/114 |
| 4,076,348 | A | | 2/1978 | Allison | 312/231 |
| 4,093,326 | A | * | 6/1978 | Ford | 312/231 |
| 4,134,614 | A | | 1/1979 | Fielding | 297/156 |
| D275,913 | S | | 10/1984 | Mulligan | D6/301 |
| 4,482,185 | A | | 11/1984 | Zoellner | 297/135 |
| 4,809,892 | A | | 3/1989 | Chinski et al. | 224/155 |
| 4,955,093 | A | | 9/1990 | Klassen | 4/579 |
| 5,201,536 | A | * | 4/1993 | Bono et al. | 280/30 |
| 5,330,248 | A | | 7/1994 | Smyly et al. | 297/174 |
| 5,390,999 | A | | 2/1995 | Fuller | 312/235.5 |
| 5,882,070 | A | | 3/1999 | Genn | 297/174 |
| 6,012,696 | A | * | 1/2000 | Borie | 248/461 |
| 6,068,355 | A | * | 5/2000 | Thorp | 312/241 |
| 6,186,593 | B1 | | 2/2001 | Garneau | 297/188.01 |
| 6,267,393 | B1 | * | 7/2001 | Mengrone et al. | 280/37 |
| 6,302,032 | B1 | | 10/2001 | Ranspach | 108/12 |
| 6,371,495 | B2 | * | 4/2002 | Thompson | 280/30 |

OTHER PUBLICATIONS

Advertisement dated Dec. 1997 for "EZ Art Easel".
Catalog Advertisement for "Safari French Easel".

* cited by examiner

*Primary Examiner*—Ramon O. Ramirez
*Assistant Examiner*—Jon Szumny
(74) *Attorney, Agent, or Firm*—Fitch, Even, Tabin & Flannery

(57) ABSTRACT

A portable artist's horse includes a pair of generally parallelepiped bench sections containing individual storage compartments which are hinged to provide a bench and pallet (or drawing board) support in an erected configuration and to allow folding to a compact travel configuration which can be easily transported by pulling or pushing. A pair of spaced-apart rollers provide mobility, and a pair of lifting handles, which are interconnected by latches, allow manipulation of the horse in transport condition. The rollers are received in pockets in the other bench section with the horse in its erected condition, and the lifting handles are integral portions of legs which stably support the bench in its erected configuration.

19 Claims, 7 Drawing Sheets

PORTABLE ARTIST'S HORSE

FIELD OF THE INVENTION

The invention relates to a portable horse for use by an artist, and more particularly to a foldable bench which can be transformed from a travel configuration, where wheels and a handle render it portable, to a working or erected configuration where it provides a seat for an artist and a support for the artist's canvas or drawing board.

BACKGROUND OF THE INVENTION

Artists and illustrators often need to draw or paint in locations remote from their studios and accordingly must transport their canvas or boards, and paints or drawing materials to such a remote location. Moreover, once they have arrived they are in need of a seat upon which to sit and an easel or other support for their canvas, drawing board or the like. In addition, one can see that the gathering and transport of all such equipment is not a simple task, and accordingly equipment that would facilitate such storage and transport in a convenient manner would be appreciated.

Over the years various solutions to this problem have been proposed. For example, U.S. Pat. No. 3,907,360 (1975) discloses an artist's horse which is collapsible to permit its portable transportation in a collapsed condition in use as a bench and easel in its erected condition. U.S. Pat. No. 4,482,185 (1984) discloses a foldable easel which converts from a compact configuration (where it is portable and can be carried) to an erect configuration where it provides a canvas seat for the artist and an easel to hold a canvas or the like. U.S. Pat. No. 5,882,070 (1999) discloses a wheeled box that is equipped with a pair of baby carriage-type wheels at one end and a handle at the opposite end for pushing or pulling the device. A seat and foldable backrest are carried above the wheeled end of the box, and a hinged folding easel is carried at the other end adjacent the handle. U.S. Pat. No. 6,186,593 (2001) discloses a combination of a chair and easel which folds to a transport configuration and unfolds to an erected configuration for supporting a board or easel in appropriate relationship to a seat for the artist. A pair of adjustable straps allow the device, in its folded configuration, to be transported in a manner similar to that in which a hiker would carry an external frame backpack.

Although these patents have proposed various different solutions to the problem of providing convenience of transportation of supplies and equipment by an artist to a location remote from the artist's studio, none of them has been totally satisfactory in providing compact secure storage and true ease of portability, and accordingly further solutions to this problem have continued to be sought.

SUMMARY OF THE INVENTION

The invention provides a portable artist's horse which includes a pair of bench sections that are hinged to each other and which each contain storage compartments; they can be folded or unfolded to transform the horse from a working or erected configuration to a compact travel configuration in which the bench sections are juxtaposed with each other at a major surface thereof. At least two rollers carried by one bench section provide portability without lifting, and a foot attached to the other bench section supports the folded artist's horse in an upright orientation. A latch arrangement secures the two bench sections in its travel configuration by interconnecting a pair of juxtaposed handles that extend from the top of each bench section in the travel configuration and facilitate lifting the horse. An extensible travel handle, attached to the bench section that carries the wheels, facilitates easy transport. In the erected or working configuration, a pair of hinged legs, parts of which double as the lifting handles in the travel configuration, provide stable support for the bench sections in an extended configuration that provides a seat for an artist and ready access to supplies. An extensible easel carried in the storage compartment in the bench section that serves as the seat provides support for a canvas in a convenient location for painting. The insertion of a foot plate into a set of slots provided in the upper surface of the extended bench in combination with the upstanding door of the other storage compartment supports a drawing board in a working orientation. Insertion of the foot plate into another set of slots facilitates transport of a board or a canvas supported upon the portable folded horse.

DETAILED DESCRIPTION OF THE PREFERRED EMBODIMENTS

Figure 1:
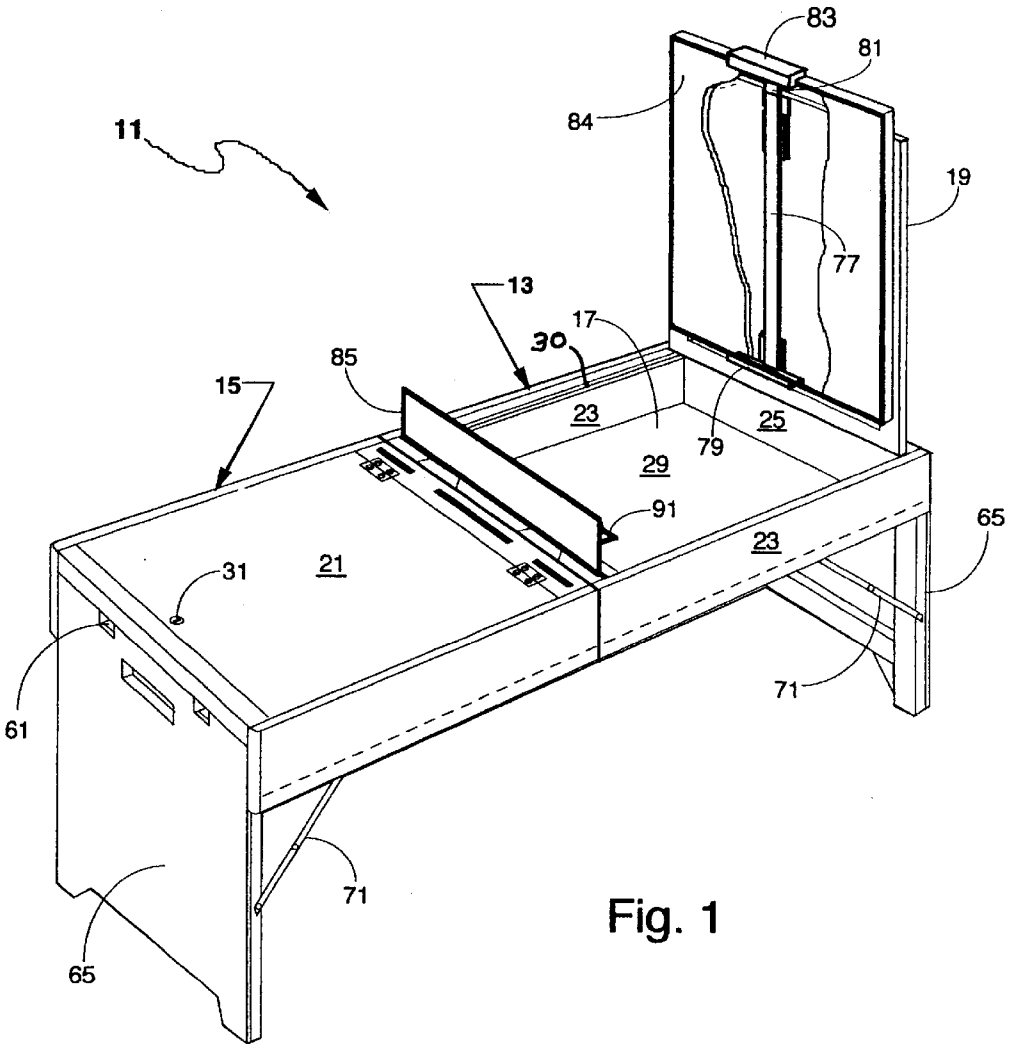
FIG. 1 is a perspective view of an artist's horse embodying various features of the present invention shown as supporting a canvas on a removable easel in a location and orientation ready for painting.
Figure 2:
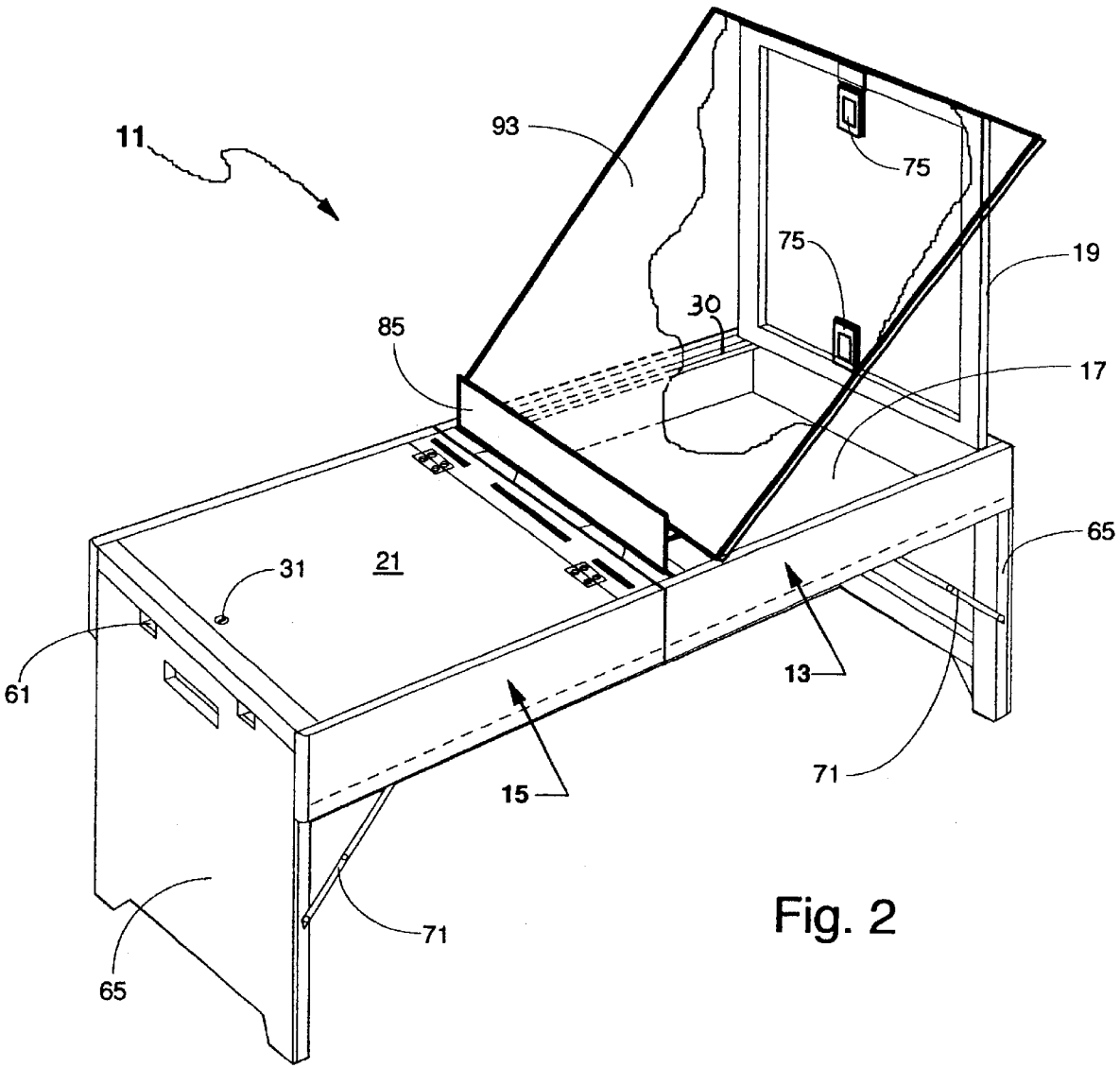
FIG. 2 is a perspective view similar to FIG. 1 showing the artist's horse with the easel removed and with a drawing board supported in an oblique position desired for drawing thereupon by an artist.
Figures 3, 4:
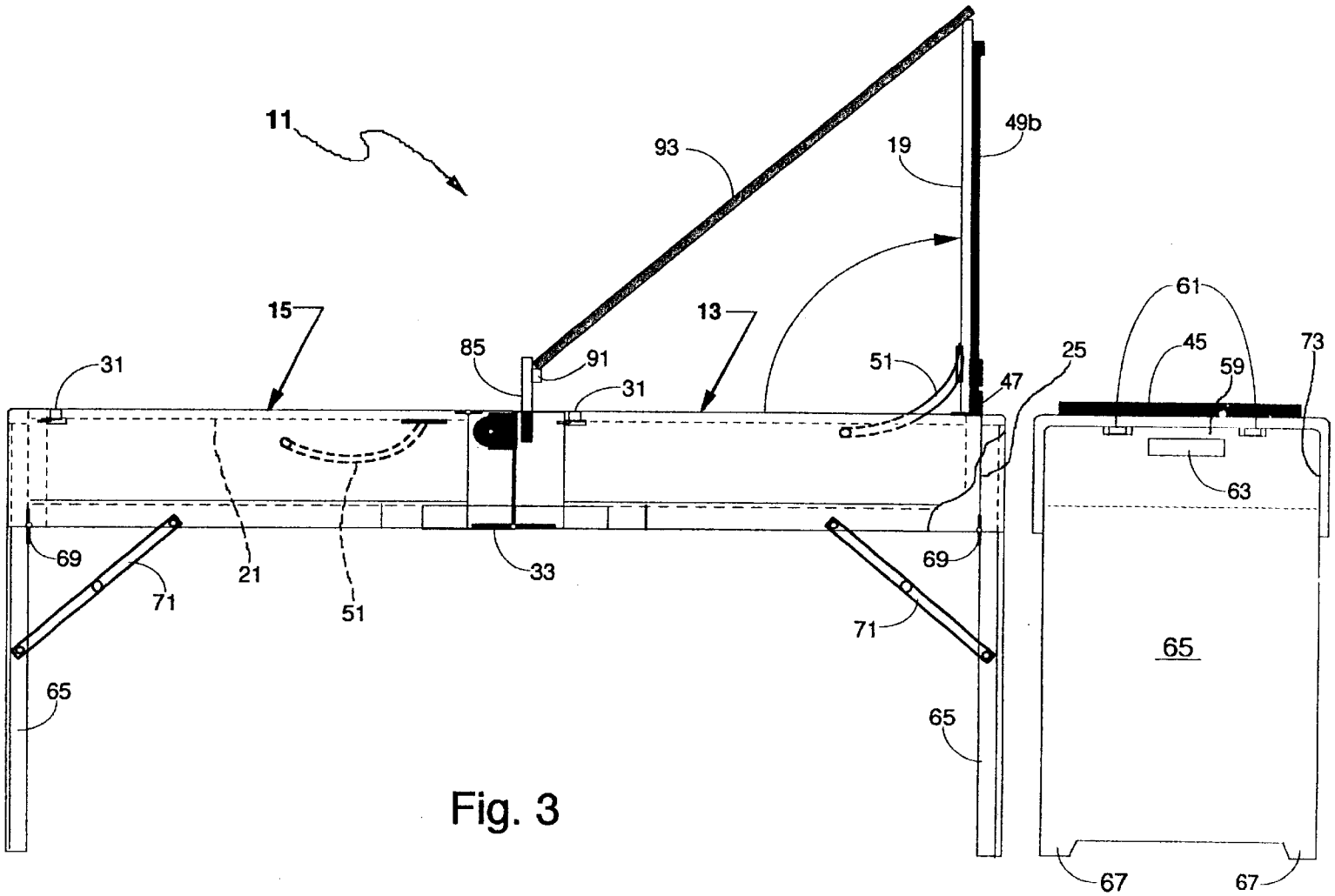
FIG. 3 is a front view, enlarged in size, with portions broken away of the horse as shown in FIG. 2.
FIG. 4 is a right side view of the horse as shown in FIG. 3 with the drawing board and its lower support removed and with the door to the storage compartment closed.

The invention provides an artist's horse 11 which, in its erected configuration, is designed to either support a canvas in a vertical orientation (FIG. 1) or to support a drawing board in an oblique orientation (FIGS. 2 and 3). The artist's horse 11 comprises a pair of bench sections which are hinged together and which are referred to as a first bench section 13 and a second bench section 15. Both bench sections have the basic shape of a rectangular parallelepiped, and each is designed to provide a storage compartment. For example, a storage compartment 17 is provided in the first bench section 13 which is closed at its upper surface by a hinged door 19.

A similar hinged door 21 provides access to a storage compartment within the second bench section 15.

Figure 5:
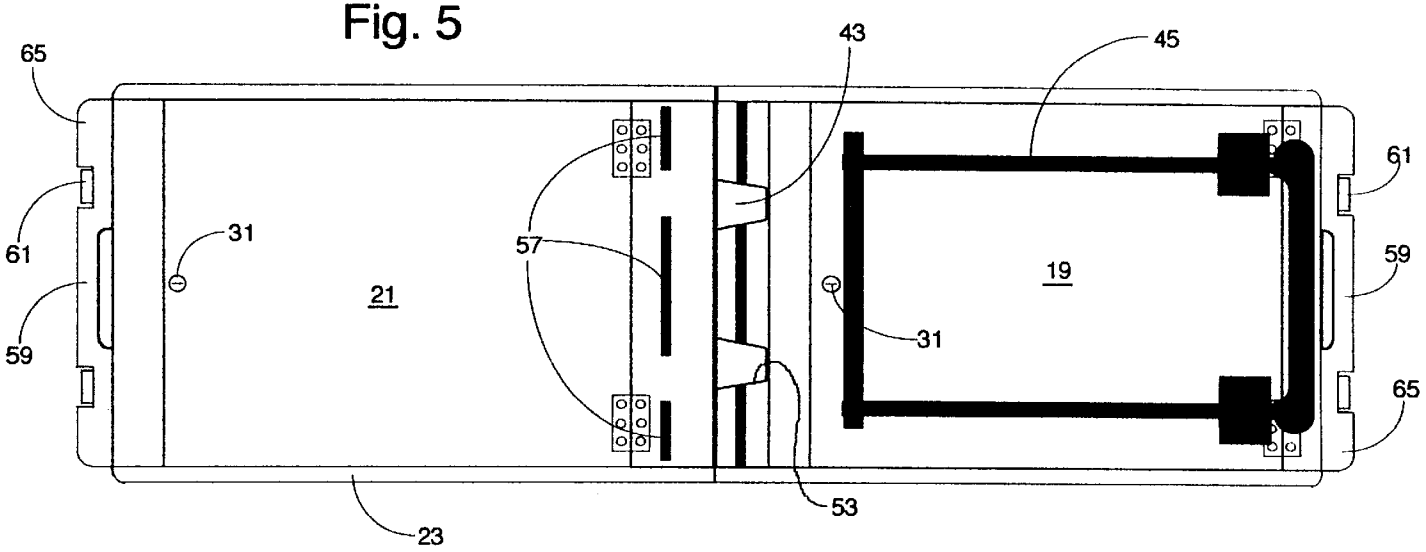
FIG. 5 is a top view of the horse shown in FIG. 4 with the legs collapsed.
Figure 7:
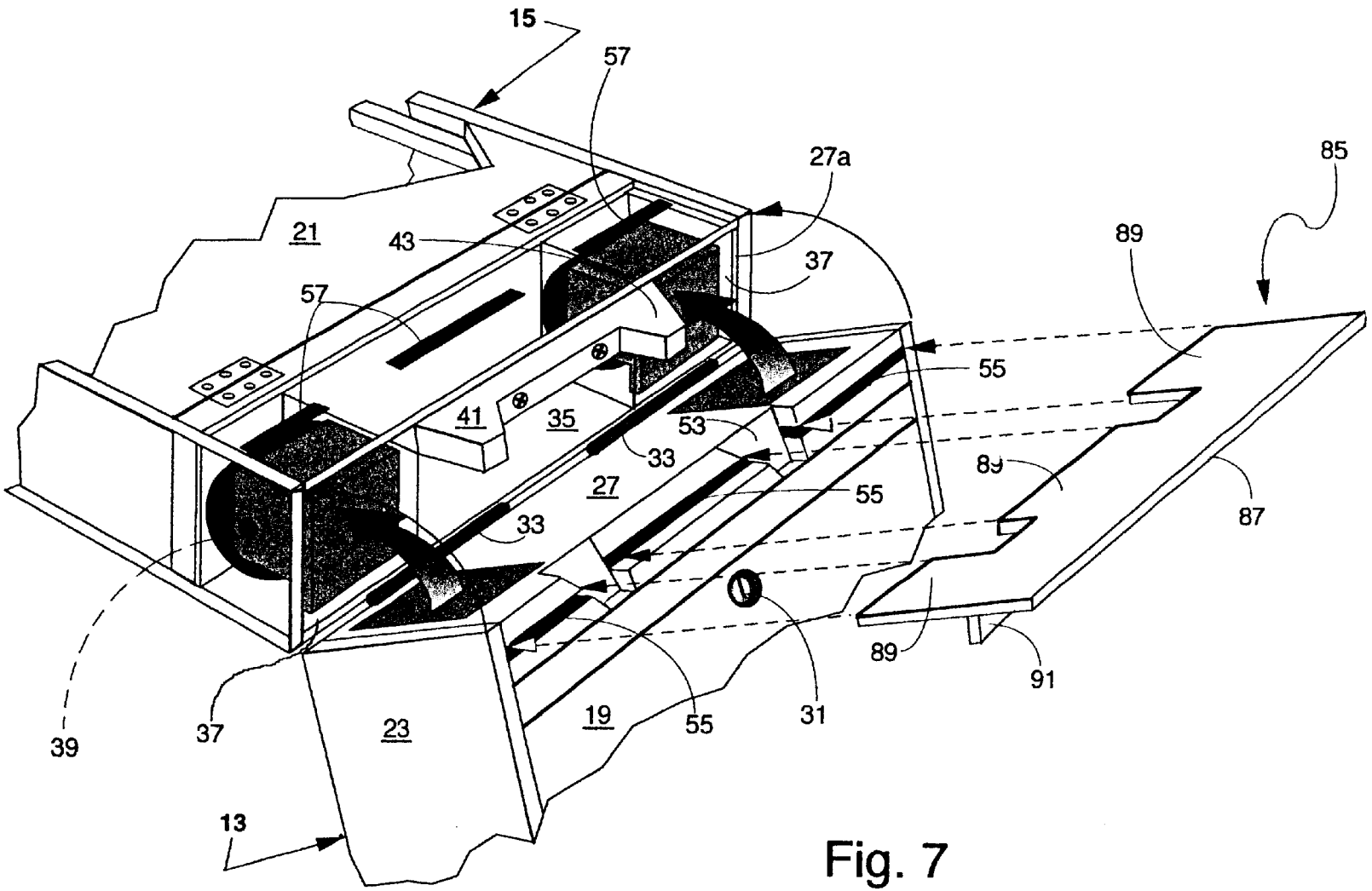
FIG. 7 is a fragmentary and exploded view, enlarged in size, which diagrammatically illustrates the movement of the hinged edges of the two bench sections as they are being opened from a collapsed configuration into the erected configuration shown in FIGS. 1 through 6.

For ease of description, the elements of the bench sections are described with reference to the erected configuration shown in FIGS. 1 and 2, and because the bench sections are essentially duplicates of each other, except for their facing inner end walls, the common parts are described only once and when referenced carry an "a" suffix. The first bench section 13 has a pair of sidewalls 23, an outer end wall 25 and an inner end region or wall 27 (see FIG. 7) which is juxtaposed with the corresponding inner end region 27*a* of the second bench section 15 in the erected configuration. The door 19 constitutes a major part of one main surface, and the other main surface is referred to as a bottom panel 29. The interior surfaces of the sidewalls 23 are preferably provided with edge strips 30 which provide positive stops and supports for the door 19 in the closed position and are located so that the upper surface of the door 19 thus lies flush with the upper edges of the sidewalls 23 and the upper edges of the end walls 25 and 27 and provides a smooth flat surface when the door is closed. As shown in FIGS. 5 and 7 for example, the door is preferably provided with a key lock 31 both for security purposes and to guard against inadvertent opening of the door when the horse is in its transport configuration, which is depicted in FIGS. 8, 9, 10 and 11.

Figure 9:
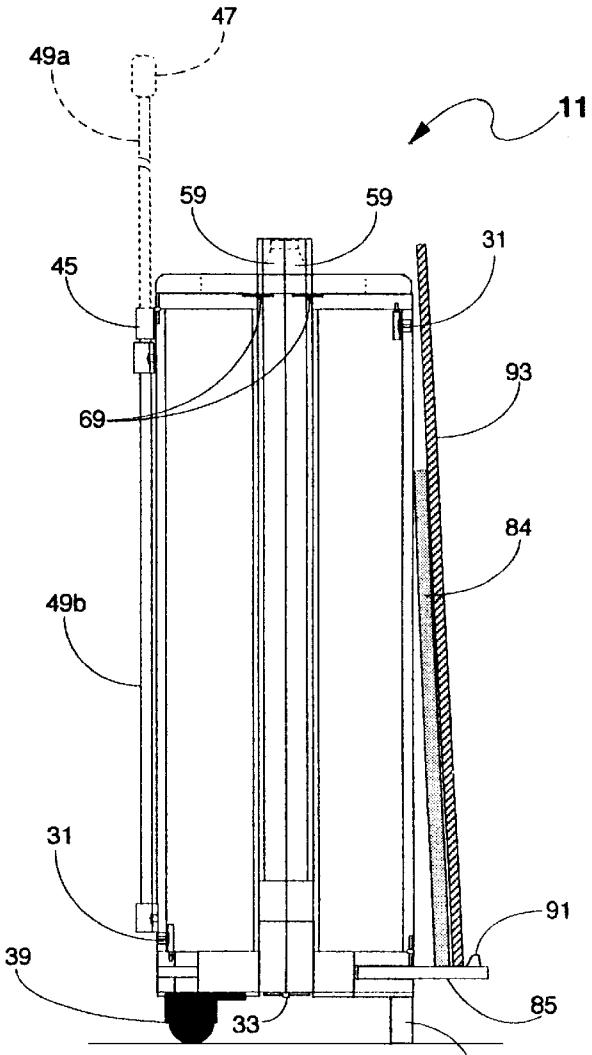
FIG. 9 is a right side elevation view of the horse as shown in FIG. 8, with a canvas and drawing board supported for transit.

The parallelepiped bench sections 13 and 15 are interconnected by a pair of hinges 33, with the plate sections of the hinges 33 being preferably mortised into the lower surfaces of the inner end regions 27, 27*a* of the bench sections so the bench sections smoothly abut each other in the transport configuration, as shown in FIG. 9. As best perhaps in FIG. 7, although the inner end wall 27 of the first box section 15 is essentially of full length extending between the two sidewalls 23, an end wall 35 of shorter longitudinal dimension is used at the other inner end region 27*a* in order to provide a pair of pockets 37 in the inner end region of the second bench section 15, which pockets receive a pair of wheels or rollers 39 as described hereinafter.

Figure 8:
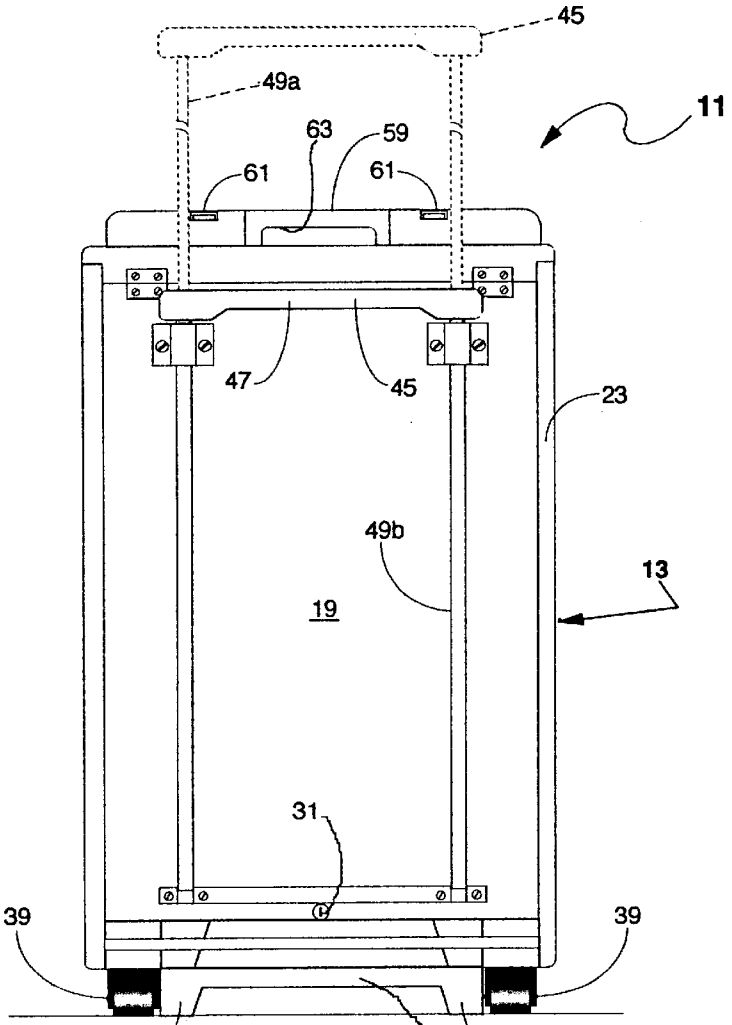
FIG. 8 is a front view of the horse shown standing upright in its folded travel configuration.

To render the horse portable and to support it in an upright orientation, two spaced apart rollers 39 are affixed to the inner end wall 27 of the first bench section 13. As best seen in FIGS. 8 and 9, the rollers are spaced substantially apart and located near the respective sidewalls 23 of the bench section. A foot member 41 is carried by the inner end wall 35 of the second box section 15 which includes a pair of spaced apart toes 43 that contact the floor or ground upon which the artist's horse is supported in upright condition. To facilitate the movement of the horse in its portable configuration, an extensible travel handle 45 is provided which is mounted on the door 19 of the first bench section 13. Although other configurations may be used, the illustrated transport handle 45 includes a central grip 47 that is affixed to the tops of a pair of vertical rods 49*a* that are telescopically received in hollow tubes 49*b* for telescopic movement. As best seen in FIG. 8, the travel handle can be withdrawn, for example about 12 inches or more, so that it can be conveniently used to pull or push the folded horse while the artist is walking. The support tubes 49*b* are suitably affixed to the exterior surface of the door by appropriate brackets or the like, and the length of the handle is such that, when it is totally collapsed as shown in full lines in FIG. 8, it does not interfere with the door 19 swinging open. Moreover, the upper end of the grip 47 is preferably flat, and the mounting of the extensible handle 45 on the door is preferably such that, when the door has been opened to the full vertical position as shown in FIG. 3, the flat edge of the grip 47 will contact the upper surface of the outer end wall 25 and thus stably support the door in an essentially vertical orientation, as can be generally discerned from FIG. 8 and as shown in FIG. 3. In addition, to more stably interconnect the door 19 to the first bench section 13 and to secure it in such a vertical orientation, a pair of arcuate sliding braces 51 are pivotally attached to the interior surface of the door and to the sidewalls 23 of the bench section, as best seen in FIG. 3, with their mounting being preferably located on the interior surface of each sidewall in the region of the storage compartment.

As best seen in FIGS. 5 and 7, the upper portion of the inner end wall 27 of the first bench section 13 is formed with a cavity 53 that is shaped to accommodate the foot member 41 affixed to the inner end wall 27*a* of the second bench section 15 when the two bench sections are aligned in the erected configuration. Moreover, the upper region is also provided with a slot 55 that extends from sidewall to sidewall for a purpose to be described hereinafter. Similarly, the upper surface of the inner end wall 27*a* of the second bench section is provided with a set of three spaced slots 57 which serve a similar purpose to the slot 55, as is explained hereinafter.

As seen for example in FIGS. 8 and 9, in the travel configuration, each of the bench sections includes a lifting handle 59 that extends upward beyond the respective inner end wall. As best seen in FIG. 9, the lifting handles 59 are juxtaposed in this configuration, and the horse is secured in the travel configuration by the inner engagement of a pair of latches 61 which, when secured to each other, prevent the two sections from thereafter pivoting at the hinges 33 until released. The provision of a hand hole 63 facilitates lifting or other manipulation of the travel horse.

As can be seen from FIG. 9, in the travel configuration, the horse 11 stands perfectly upright in vertical orientation, and in its compact condition, it can be conveniently stored in the artist's studio when not being used. However, when ready for use, the extension of the travel handle 45, as by pulling the grip 47 directly upward, extends the grip about a foot above the top of the horse and permits it to be conveniently pulled or pushed as the artist travels from his or her studio to a desired location for painting or drawing.

Once the destination is reached, the handle 45 is returned to its retracted position, and the latches 61 are opened so as to free the handles from each other. The two bench sections are then opened by pivoting about the hinges 33, as generally shown in FIG. 7. Such opening movement causes the pair of rollers 39 to be received in the two spaced apart pockets 37 and the foot 41 to be received in the central cavity 53. Pivoting movement continues until the inner end wall surfaces of the two bench sections abut each other, at which time the horse appears as shown in FIGS. 5 and 6 and in this configuration, the lifting handles 59 still extend from opposite ends of the aligned bench sections.

Figure 6:
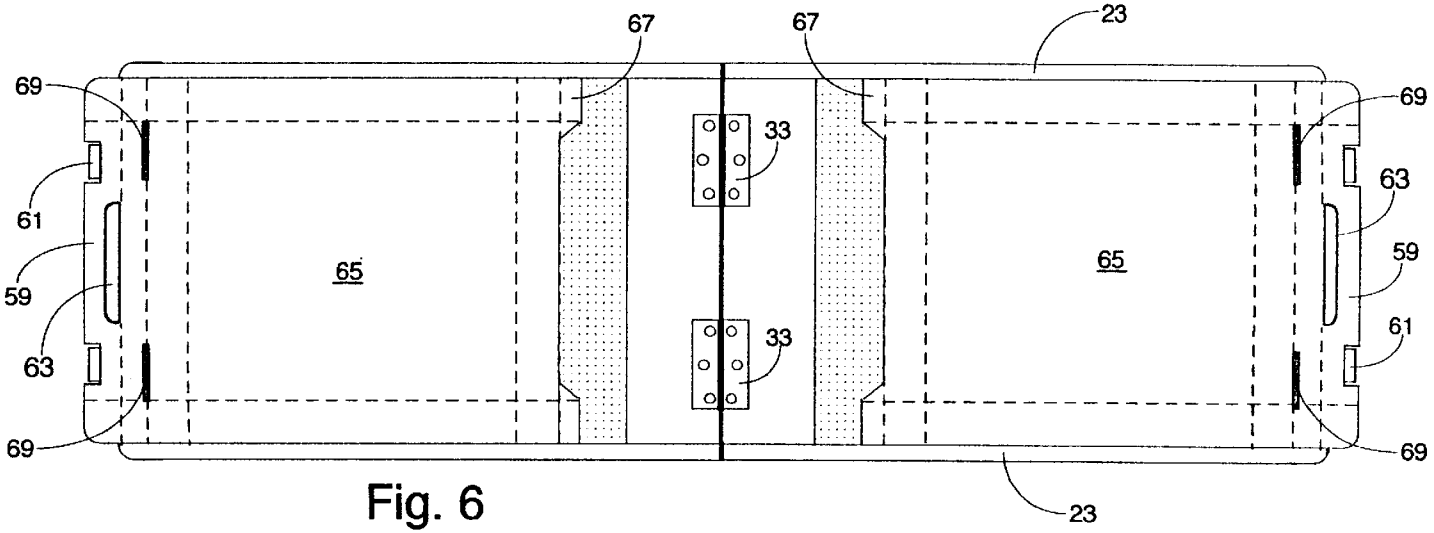
FIG. 6 is a bottom view of the horse in the configuration shown in FIG. 5.
Figure 10:
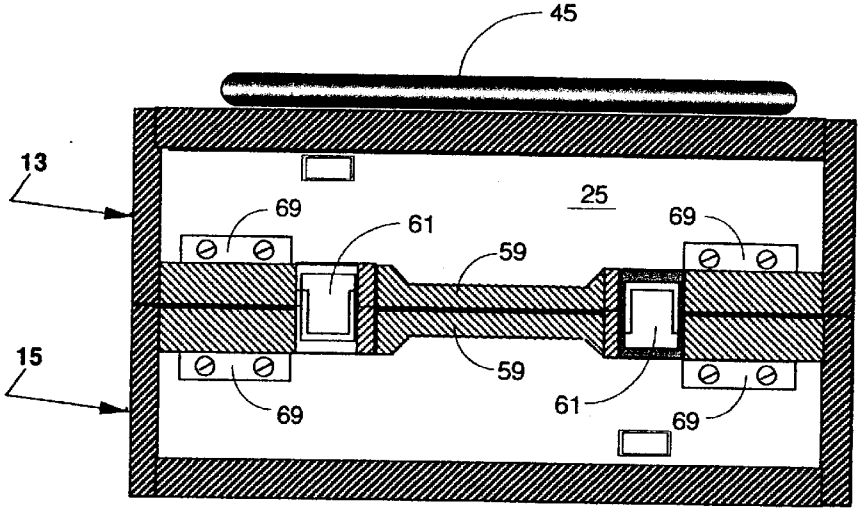
FIG. 10 is a top view of the horse shown in FIG. 9 but enlarged in size.
Figure 11:
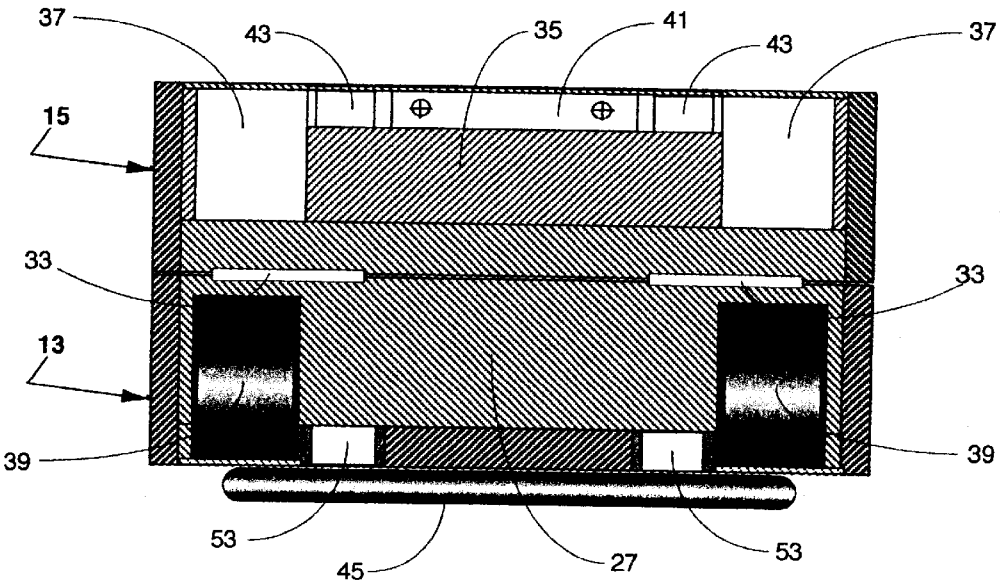
FIG. 11 is a bottom view of the horse as shown in FIG. 10.

As best seen in FIG. 6, the handles 59 are integral portions of a pair of support legs 65, which legs in the illustrated embodiment are constructed in the form of wood panels, each of which is formed with a pair of feet 67 at its bottom end. Each support leg 65 is proportioned so as to be received between the sidewalls 23 of the bench section and to fit into rectangular recesses provided in the bottom surface of each of the bench sections in its collapsed configuration; thus, the support legs 65 and their lifting handle portions 59 lie in juxtaposition when the horse in its travel configuration (FIG. 9). Each leg is connected to the outer end wall 25 of the respective bench section by a pair of hinges 69. The hinges 69 are preferably mortised into the end surfaces of the outer end walls 25 of the bench sections, as best seen in FIG. 10; they may also be mortised into the interior surface at the top of each of the support legs so that when the support legs pivot into the collapsed storage position in the recesses provided between the sidewalls of each bench section, they occupy a minimum amount of space. To provide the support legs with stability in the erected position, a folding strut 71 is provided along an outer edge of each leg which is connected to the inner surface of the sidewalls 23. To accommodate the folding struts 71, the side edges of the support legs are preferably cut away to provide shallow cavities within which they are received in the folded, stored position. The illustrated hinge placement, where the hinges 69 are mounted at a location on the interior surface of the support legs 65 below the lifting handle portions, provides additional stability in the erected configuration as a result of interengagement between the lifting handle portions of the legs and the outer end surfaces 25 of the bench sections. As can best be seen from FIGS. 3 and 4, the outer end walls of the bench sections are provided with recesses 73 which receive the lifting handle portions 59 of the support legs in the erected configuration.

Once the artist has reached the destination where he wishes to paint or draw, the extensible travel handle 45 is returned to its storage condition, as depicted in FIGS. 3 and 5 and in full lines in FIG. 8. The latches 61, which interconnected the juxtaposed lifting handles, are then unlatched; thereafter, the horse can either be positioned on its side or with the door 21 of the second bench section resting flat on the ground, and the two bench sections then pivoted about the hinge 33. Once the two bench sections 13, 15 are in alignment, the support legs 65 can be pivoted to their support positions from their storage positions and locked in this orientation by engaging the folding struts 71, as shown in FIG. 3. With both support legs 65 extended and locked, the horse can be set up into its working position; the storage compartments can then be accessed through the top doors 21 and 19 once both have been opened. It is contemplated that the door 19 would then remain in the vertical essentially position, as shown in FIGS. 1, 2 and 3, whereas the door 21 would be closed, once the articles in the storage compartment have been withdrawn, to provide a seat for the artist. The storage compartment in the second bench section 15 provides convenient storage for a slidable easel and a foot plate or shelf plate support and can also readily and conveniently store an auxiliary support stand, made of interconnected panels, which holds a pallet, a cup of water and the like to assist the artist when painting.

As best seen in FIG. 2, the door 19 to the first bench section carries upper and lower attachment means, i.e. support brackets 75 on its interior surface. A first easel member 77 carries a pair of lugs (not shown) on its rear surface which interengage with the support brackets 75 and thus mount the first easel member 77 extending vertically on the opened door 19, as shown in FIG. 1. On its front surface, the first easel member carries a horizontally extending shelf 79 designed to receive the bottom edge of an artist's canvas. A second or upper easel member 81 is extensibly linked with the first easel member, preferably in a telescoping arrangement, so that it can slide upward or downward to accommodate a canvas of varying size. The second easel member 81 carries a keeper 84 at its upper end which is proportioned to fit about the upper edge of an artist's canvas 85, as shown in FIG. 1, and thus support the canvas in an essentially vertical or slightly past vertical orientation convenient for the artist to paint upon.

If, instead of using the horse for painting, it is desired to use it to support a drawing board, the easel support members 77 and 81 are left in the storage compartment of the second bench section 15, and a foot plate 85 is interconnected with the first bench section 13. The foot plate 85 is best seen in FIG. 7, and it consists of a plate 87 that is formed so as to have three tongues 89. The plate carries an intermediate flange 91 which extends perpendicular thereto from one surface thereof. With the artist's horse in its erected configuration with the door 19 upstanding, the three tongues 89 of the support 85 are inserted downward into the long slot 55 provided in the upper surface of the first bench section 13 so that the tongues 89 flank the toes 43 of the foot member 41 and with the flange 91 facing the upraised door 19. This arrangement is shown in FIG. 1 simply for illustration as it would not be used when painting a canvas 84; it is also shown in FIGS. 2 and 3 as providing support for the bottom edge of a drawing board 93 supported in an oblique position upon the upper edge of the open door 19.

The foot plate 85 also doubles as a transport support for a canvas or drawing board when the horse 11 is in the travel configuration as shown in FIG. 9. In this respect, the three slots 57 mentioned previously in the upper surface of the second bench section near its interior end wall are dimensioned to accept the three tongues 89, as best seen perhaps in FIGS. 5 and 7, which can be inserted whenever the rollers 39 are not disposed in the pockets 37. This arrangement is depicted in FIG. 9 where the foot plate 85 is inserted with the flange 91 facing upward. When so inserted, it provides a bottom support or base on which a drawing board and/or a canvas can be supported so that they lean against the door 21 of the second bench section when the horse is tilted and being pulled by the artist using the extended handle 45. FIG. 9 shows both a drawing board and a canvas supported for transport in the case of an artist wishing to paint and sketch at a single destination.

From the foregoing discussion of this preferred embodiment, it can be seen that there has been provided a compact and useful artist's horse which sturdily and comfortably supports an artist while he is sketching or painting at a destination removed from his studio. However, it not only provides for convenient and accessible storage for paint brushes, drawing implements, etc., as well as an adjustable easel and optionally a folded auxiliary support for a pallet and/or water cup, but in addition it is easily manipulated to a transport configuration wherein it can be easily wheeled using a conveniently extensible transport handle while supporting a drawing board and/or canvas on the wheeled device.

Although the invention has been described with regard to a preferred embodiment which constitutes the best mode contemplated by the inventor for carrying out his invention, it should be understood that various changes and modifications, as would be obvious to one having the ordinary skill in this art, may be made without departing from the scope of the invention which is set forth in the claims appended hereto. For example, although the artist's horse is illustrated as being primarily made from wood, it should be understood that other materials could be used; for example, the bench sections and legs and doors might be mass produced from metal. Likewise, other hinge placement or other latches and/or struts may be used, or the door 21 might be hinged along one of its other three edges.

Particular features of the invention are set forth in the claims that follow.

What is claimed is:

1. A portable artist's horse which comprises a foldable bench which provides a seat for an artist and which includes first and second bench sections, both of which include storage compartments for holding artist materials, said bench sections each having first and second end regions, first and second main body regions and a pair of sidewalls, a hinge arrangement interconnecting said bench sections so that, in a folded travel configuration, said first main body regions lie in juxtaposition and, in an extended working configuration, said first end regions lie in juxtaposition, said hinge arrangement being affixed to said end regions and creating a common axis at said first end regions about which pivoting occurs during transition between said two configurations.

a latch arrangement securing said bench sections in travel configuration, said first end region of said first bench section having at least two rollers at spaced apart locations, and said first end region of said second bench section having a pocket to accept and totally contain each said roller when said bench sections are in the working configuration, and a foot attached to and extending from said first end region of said second bench section to support the portable horse in upright orientation in said travel configuration, said first end region of said first bench section having a cavity to receive said foot in the working configuration.

2. The portable horse according to claim 1 wherein each of said bench sections has an upstanding handle, which handles lie in juxtaposition in the travel configuration and extend upward from said second end regions, and wherein said latch arrangement interconnects said handles.

3. The portable horse according to claim 1 wherein an extensible transport handle is secured to said second main body region of said bench section which has said two rollers attached thereto.

4. The portable horse according to claim 1 wherein said cavity which receives said foot is located between said two rollers.

5. The portable horse according to claim 1 wherein each of said bench sections has a hinged door which forms a major portion of said second main body region thereof and, when opened, provides access to a storage compartment located between said sidewalls of each bench section.

6. The portable horse according to claim 5 wherein the door which forms a part of the bench section that carries said wheels has first attachment means affixed to its undersurface, and wherein an easel support arrangement is provided, which fits within one of said storage compartments and carries complementary second attachment means permitting its mounting on the opened door so as to support a pallet.

7. The portable horse according to claim 6 wherein a mechanism is provided for positioning said hinged door in essentially vertical orientation and wherein said easel support includes two axially slidably interconnected pieces, each carrying frame-engaging supports for accommodating a canvas of varying dimension.

8. The portable horse according to claim 7 wherein said second main body region of said first bench section, in a location spaced from an edge of said door, includes slots and wherein a foot plate having a set of tongues which are received in said slots can be accommodated in an orientation transverse to the upper surface of said second main body region in the extended configuration and serve as a lower support for a drawing board that can lean against the top edge of said open door, said foot plate being of a size to be accommodated within one of said storage compartments.

9. The portable horse according to claim 8 wherein said second main body region of said second bench section, in a location spaced from an edge of the door to the storage compartment therein, contains a set of slots which similarly receive tongues of said foot plate, which when inserted therein provides a base for transporting a drawing board or the like on said horse in the travel position.

10. A portable artist's horse which comprises a foldable bench which provides a seat for an artist and which includes first and second bench sections, said bench sections each having first and second end regions, first and second main body regions and a pair of sidewalls, each of said bench sections having a hinged door which forms a major portion of said second main body region thereof and, when opened, provides access to a storage compartment located between said sidewalls of each bench section, a hinge arrangement interconnecting said bench sections so that, in a folded travel configuration, said first main body regions lie in juxtaposition and, in an extended working configuration, said first end regions lie in juxtaposition, said first end region of said first bench section having a roller arrangement to permit said horse to be easily pushed or pulled in its travel configuration, and said first end region of said second bench section having pocket means to accept said roller arrangement rams and allow said first end regions of said bench sections to lie in abutting contact in the working configuration, and a foot moms extending from said first end surface region of said second bench section to support the portable horse in upright orientation in said travel configuration.

11. The portable horse according to claim 11 wherein said bench sections include legs which are each respectively integral with one of said handles and which are respectively hingedly connected to one of said second end regions, said legs being received in recesses provided in said first main body regions when said bench sections are in the folded travel configuration.

12. The portable horse according to claim 11 wherein said handles are received in hollows provided in each of said second end regions when said legs have been pivoted to their extended positions and abut surfaces of said second end regions to provide stability, and wherein pivoting foldable struts interconnect generally center portions of said legs and sidewalls of said respective bench sections to provide further stability.

13. The portable horse according to claim 10 wherein each of said bench sections has an upstanding handle that protrudes upward from said second end section in said travel configuration, which handles lie in juxtaposition in the travel configuration and extend upward from said second end regions, and wherein a latch arrangement interconnects said handles in said travel configuration.

14. The portable horse according to claim 10 wherein an extensible transport handle is secured to said second main body region of said first bench section.

15. The portable horse according to claim 10 wherein a cavity in the first end surface of said first bench section receives said foot and is located between two spaced rollers which constitute said roller arrangement.

16. The portable horse according to claim 10 wherein the door which forms a part of the first bench section has first attachment means affixed to its undersurface, and wherein an easel support arrangement is provided that fits within one of said storage compartments and that carries complementary second attachment means permitting its mounting on the opened door so as to support a pallet.

17. A portable artist's horse which comprises a foldable bench which includes first and second bench sections, at least one of which includes a storage compartment, said bench sections each having first and second end regions, first and second main body regions and a pair of sidewalls, a hinge arrangement interconnecting said sections so that, in a folded travel configuration, said first main body regions lie in juxtaposition and, in an extended working configuration, said first end regions lie in juxtaposition, a latch arrangement securing said bench sections in travel configuration, said first end region of said first bench section having at least two rollers at spaced apart locations, and said first end region of said second bench section having a pocket to accept each said roller when said bench sections arc in the working configuration, said bench sections including legs which are each respectively integral with one of said handles and which are respectively hingedly connected to said second end region, said legs being received in recesses provided in said first main body regions when said bench sections are in the folded travel configuration, and a foot attached to and extending from said first end region of said second bench section to support the portable horse in upright orientation in said travel configuration, said fist end region of said first bench section having a cavity to receive said foot in the working configuration.

18. The portable horse according to claim 17 wherein said upstanding handle portions lie injuxtaposition in the travel configuration, and wherein said latch arrangement interconnects said handle portions.

19. The portable horse according to claim wherein said handle portions are received in hollows provided in each of said second end regions when said legs have been pivoted to their extended positions and abut surfaces of said second end regions to provide stability, and wherein pivoting foldable struts interconnect generally center portions of said legs and sidewalls of said respective bench sections to provide further stability.

* * * * *